US012006674B2

(12) United States Patent
Schaldach

(10) Patent No.: US 12,006,674 B2
(45) Date of Patent: Jun. 11, 2024

(54) TOILET SKIRT

(71) Applicant: Nina L. Schaldach, Wadsworth, OH (US)

(72) Inventor: Nina L. Schaldach, Wadsworth, OH (US)

(73) Assignee: Nina L. Schaldach, Wadsworth, OH (US)

( * ) Notice: Subject to any disclaimer, the term of this patent is extended or adjusted under 35 U.S.C. 154(b) by 617 days.

(21) Appl. No.: 17/017,061

(22) Filed: Sep. 10, 2020

(65) Prior Publication Data

US 2021/0079639 A1 Mar. 18, 2021

Related U.S. Application Data

(60) Provisional application No. 62/900,819, filed on Sep. 16, 2019.

(51) Int. Cl.
*A47K 13/00* (2006.01)
*E03D 11/13* (2006.01)

(52) U.S. Cl.
CPC ..... *E03D 11/13* (2013.01)

(58) Field of Classification Search
CPC ..... A47K 13/14; A47K 13/16; A47K 13/24; A47K 13/242; A47K 17/00; E03D 11/13; E03D 11/02; E03C 2001/321
See application file for complete search history.

(56) References Cited

U.S. PATENT DOCUMENTS

| | | | | | |
|---|---|---|---|---|---|
| 2,658,201 | A * | 11/1953 | Yorke | E03D 11/02 | 4/300 |
| 3,085,611 | A * | 4/1963 | Dolnick | A47K 13/24 | D23/311 |
| 4,089,073 | A | 5/1978 | Campbell | | |
| 4,160,295 | A | 7/1979 | Putyra | | |
| 5,067,185 | A | 11/1991 | Kohler | | |
| 5,557,809 | A * | 9/1996 | Adams | A47K 13/16 | 4/245.3 |
| 6,174,581 | B1 | 1/2001 | Barker | | |
| 7,458,109 | B1 | 12/2008 | Kreisel | | |
| 8,011,401 | B1 * | 9/2011 | Utterback | A47K 17/00 | 4/901 |
| 9,845,593 | B2 | 12/2017 | Hall et al. | | |
| D825,044 | S * | 8/2018 | Johannes | D23/311 | |
| 10,167,617 | B2 | 1/2019 | Hall et al. | | |
| 10,301,807 | B1 * | 5/2019 | Kolesar | A47K 13/26 | |
| 2016/0369488 | A1 * | 12/2016 | Todd, IV | E03D 9/00 | |
| 2017/0058502 | A1 * | 3/2017 | Welliver | E03D 11/13 | |

FOREIGN PATENT DOCUMENTS

WO 2008010570 A1 1/2008

* cited by examiner

*Primary Examiner* — Jun S Yoo
(74) *Attorney, Agent, or Firm* — Taft Stettinius & Hollister LLP

(57) ABSTRACT

An exemplary method relates to retrofitting a toilet comprising a base portion having a recessed rear portion and a front portion including a first side surface and a second side surface opposite the first side surface. The method generally includes adhering a first end of a skirt to the first side surface, wrapping the skirt around the recessed rear portion such that the recessed rear portion is covered by the skirt, and adhering a second end of the skirt to the second side surface.

17 Claims, 4 Drawing Sheets

TOILET SKIRT

CROSS-REFERENCE TO RELATED APPLICATIONS

The present application claims the benefit of U.S. Provisional Patent Application No. 62/900,819, filed Sep. 16, 2019, the contents of which are incorporated by reference in their entirety.

TECHNICAL FIELD

The present disclosure generally relates to toilets, and more particularly but not exclusively relates to skirts for toilets.

BACKGROUND

The rear sides of toilets are typically difficult to reach for cleaning purposes, and often include crevices that accumulate dirt and grime. While certain commercially-available toilets are skirted to eliminate these crevices and facilitate cleaning, these toilets are often significantly more expensive than their non-skirted counterparts. Additionally, these skirted toilets require that an entirely new toilet be purchased and installed, and cannot be used to retrofit an existing installation. For these reasons among others, there remains a need for further improvements in this technological field.

SUMMARY

An exemplary method relates to retrofitting a toilet comprising a base portion having a recessed rear portion and a front portion including a first side surface and a second side surface opposite the first side surface. The method generally includes adhering a first end of a skirt to the first side surface, wrapping the skirt around the recessed rear portion such that the recessed rear portion is covered by the skirt, and adhering a second end of the skirt to the second side surface. Further embodiments, forms, features, and aspects of the present application shall become apparent from the description and figures provided herewith.

DETAILED DESCRIPTION OF ILLUSTRATIVE EMBODIMENTS

Figure 2:
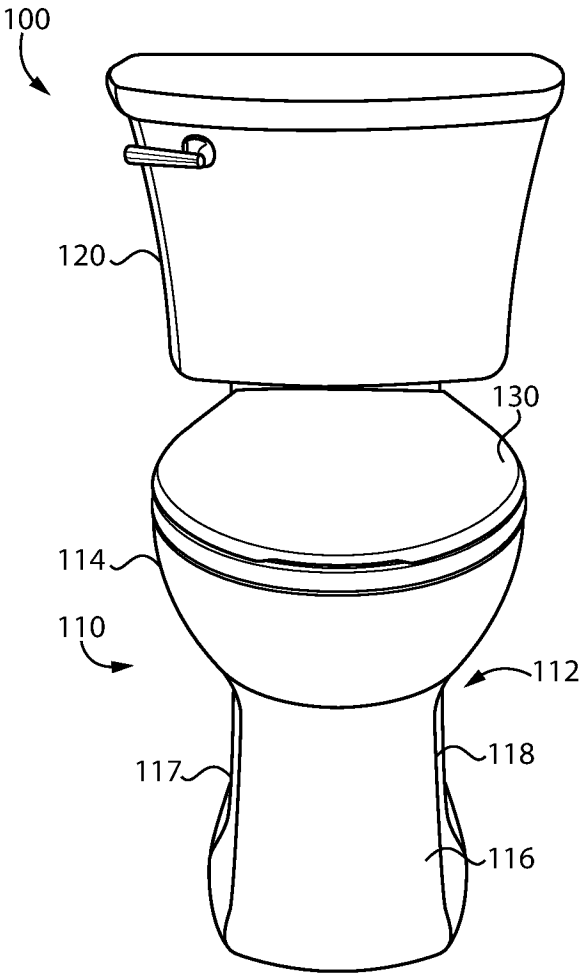
FIG. 2 is a front view of the toilet illustrated in FIG. 1.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

Figure 1:
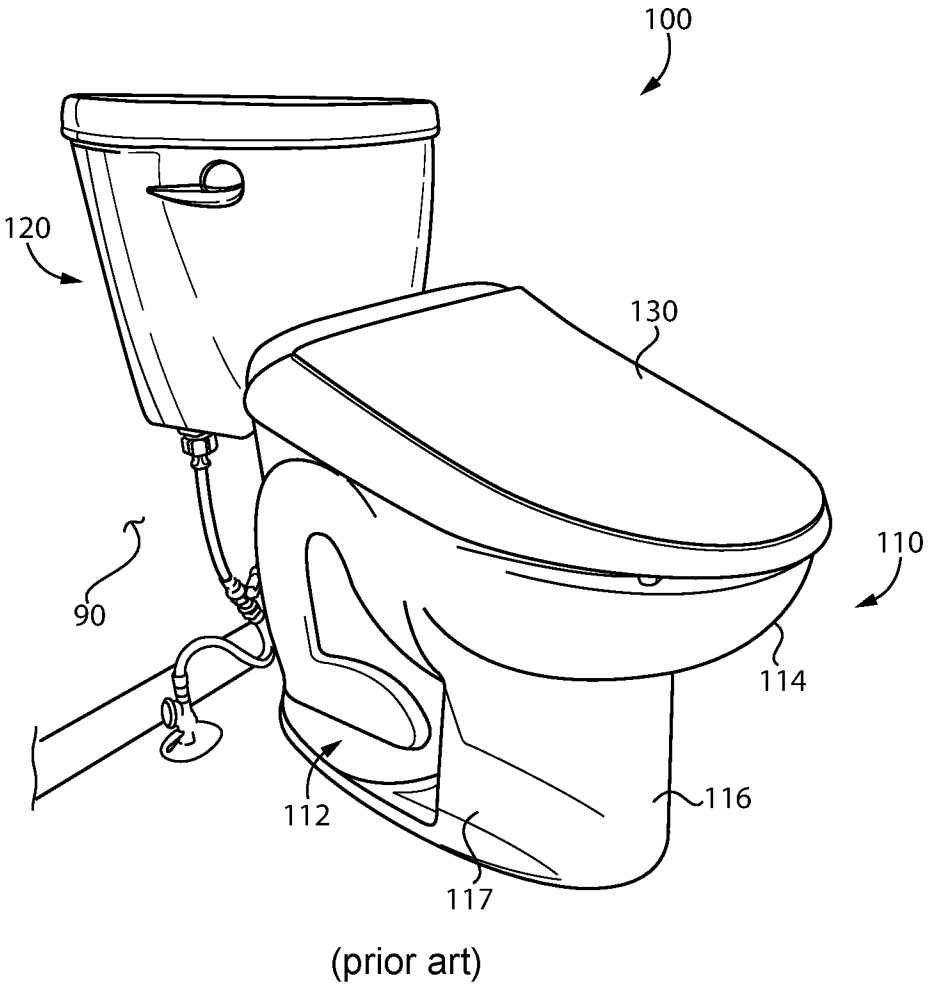
(prior art) FIG. 1
FIG. 1 is a perspective view of a toilet that may be utilized in connection with certain embodiments.

With reference to FIGS. 1 and 2, illustrated therein is a toilet 100 that may be utilized in connection with certain embodiments. The toilet 100 includes a base portion 110, a tank 120 mounted to the base portion 110, and a lid 130. The base portion 110 includes a recessed rear portion 112, a bowl 114, and a front portion 116 having a first side surface 117 and an opposite second side surface 118. As is typical, the rear portion 112 extends from the front portion 116 toward a wall 90. The toilet 100 is a conventional toilet, and may be of any type known in the art. As such, the toilet 100 need not be described in further detail herein.

Figure 3:
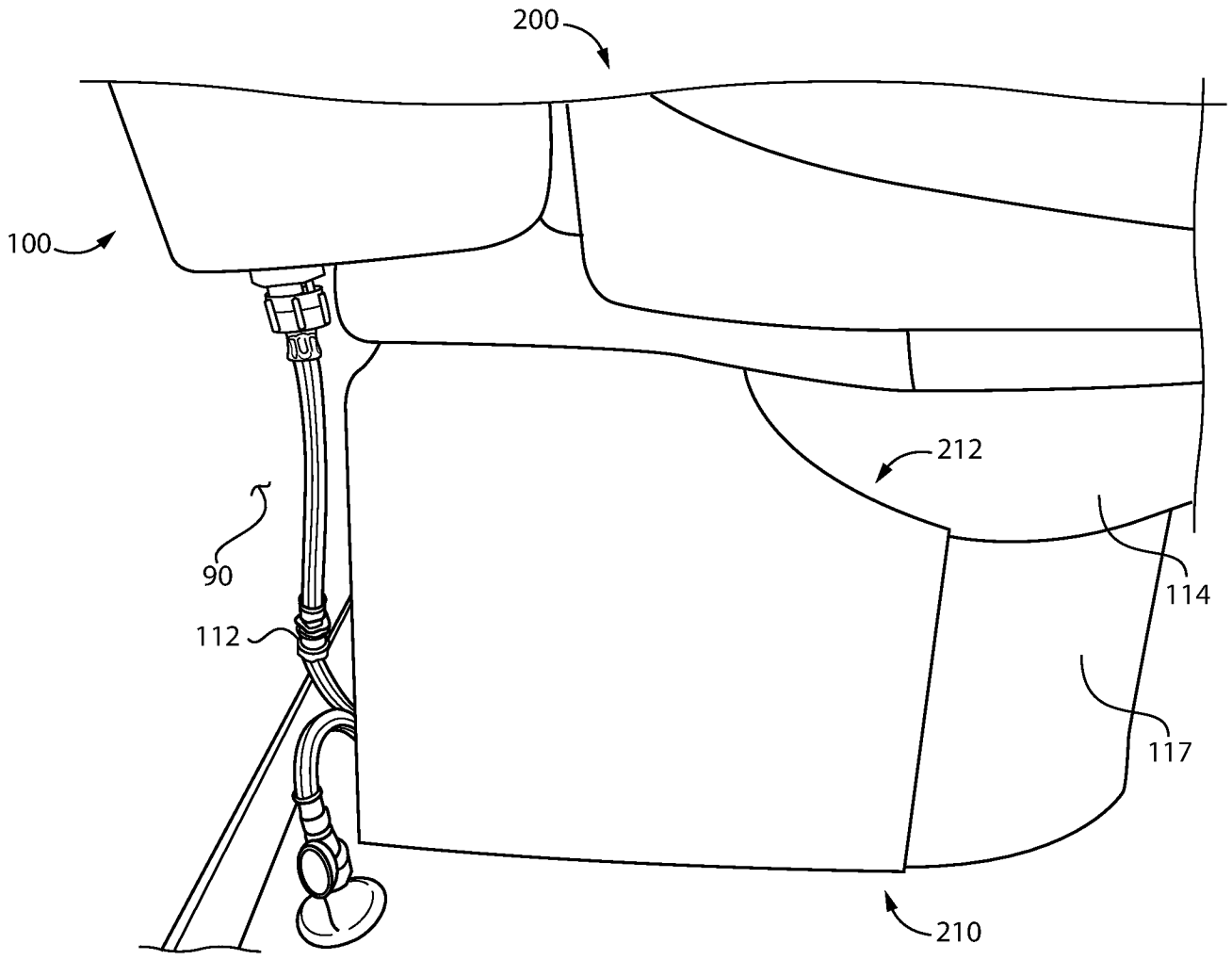
FIG. 3 is a side view of a toilet assembly that includes the toilet and a skirt according to certain embodiments.

With additional reference to FIG. 3, illustrated therein is a toilet assembly 200 according to certain embodiments. The toilet assembly 200 generally includes the toilet 100 and a toilet skirt 210 according to certain embodiments. The toilet skirt 210 is mounted to the base portion 110 of the toilet 100, and wraps around the rear side of the toilet 100 and covers the recessed rear portion 112. In the illustrated form, the skirt 210 includes a pair of curved cutouts 212, each of which accommodates a corresponding and respective portion of the bowl 114. In other embodiments, the cutouts 212 may be tapered or straight. Additionally or alternatively, a portion of the skirt 210 may be feathered to fit the bowl 114.

Figure 4:
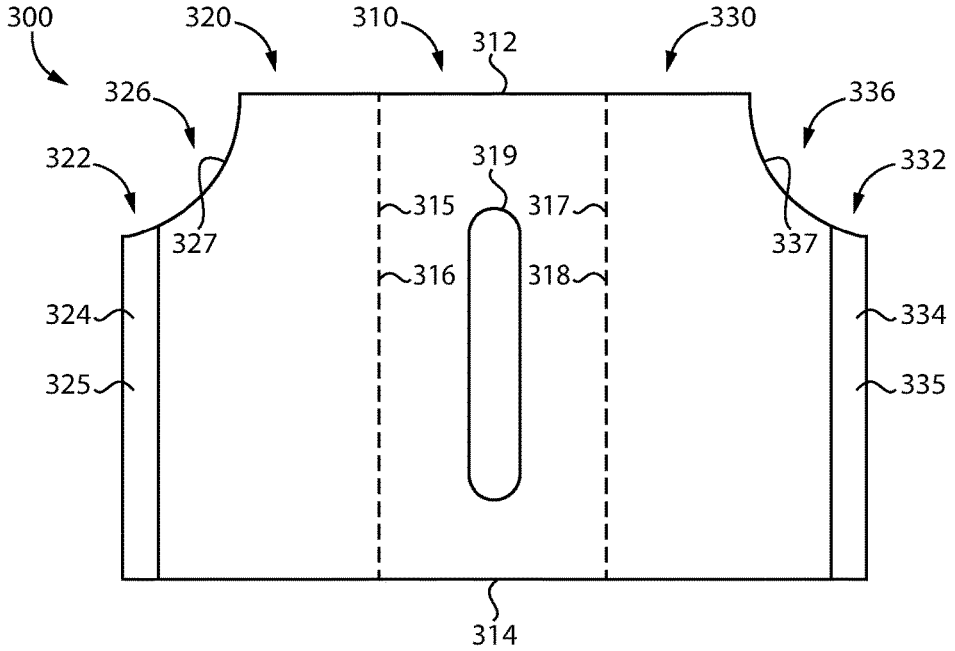
FIG. 4 is a plan view of a skirt according to certain embodiments.

With additional reference to FIG. 4, illustrated therein is a skirt 300, which is one example of the skirt 210. The skirt 300 generally includes a base panel 310, a first side panel 320 extending from a first side of the base panel 310, and a second side panel 330 extending from the opposite second side of the base panel 310. The skirt 210 may be formed of a rigid or semi-rigid material such that the skirt 210 at least partially retains its shape when installed to the toilet 100. While other materials and forms are contemplated, in the illustrated embodiment, the skirt 300 is formed of a plastic sheet.

The base panel 310 includes an upper edge 312, a lower edge 314, a first side 316 extending between the upper edge 312 and the lower edge 314, and an opposite second side 318 extending between the upper edge 312 and the lower edge 314. In certain forms, the first side 316 may be defined by a crease 315 or radius and/or the second side 318 may be defined by a crease 317 or radius. Creases 315, 317 may, for example, be provided in the form of an indented line and/or a line of perforations. In certain forms, such creases 315, 317 may be omitted. In certain forms, the base panel 310 further includes a center cutout 319 sized and shaped to accommodate a portion of the rear portion 112.

The first side panel 320 extends from the first side 316 of the base panel 310 to a first end 322 of the skirt 300. The first end 322 may have positioned thereon a first releasable securing means such as a first adhesive region 324, which may be covered by a removable protective film 325. It is also contemplated that the first securing means may be provided in another form, such as one that includes a hook-and-loop fastener strip, a hook-hook fastener strip, and/or one or more suction cups. The first side panel 320 may further include a cutout 326 sized and shaped to accommodate a portion of the bowl 114. The cutout 326 may have a curved edge 327 that generally conforms to the curved line defining the intersection of the bowl 114 and the first side surface 117. It is also contemplated that the edge 327 may be tapered or straight to define the cutout 326 as a tapered or straight cutout.

In the illustrated form, the second side panel 330 is a mirror image of the first side panel 320, and extends from the second side 318 of the base panel 310 to a second end 332 of the skirt 300. It is also contemplated that the second side panel 330 may not necessarily be a mirror image of the first side panel 320. The second end 332 may have positioned thereon a second releasable securing means such as a second adhesive region 334, which may be covered by a removable protective film 335. It is also contemplated that the second securing means may be provided in another form, such as one that includes a hook-and-loop fastener strip, a hook-hook fastener strip, and/or one or more suction cups. The second side panel 330 may further include a cutout 336 sized and shaped to accommodate a portion of the bowl 114. The cutout 336 may have a curved edge 337 that generally conforms to the curved line defining the intersection of the bowl 114 and the second side surface 118. It is also contemplated that the edge 337 may be tapered or straight to define the cutout 336 as a tapered or straight cutout.

Figure 5:
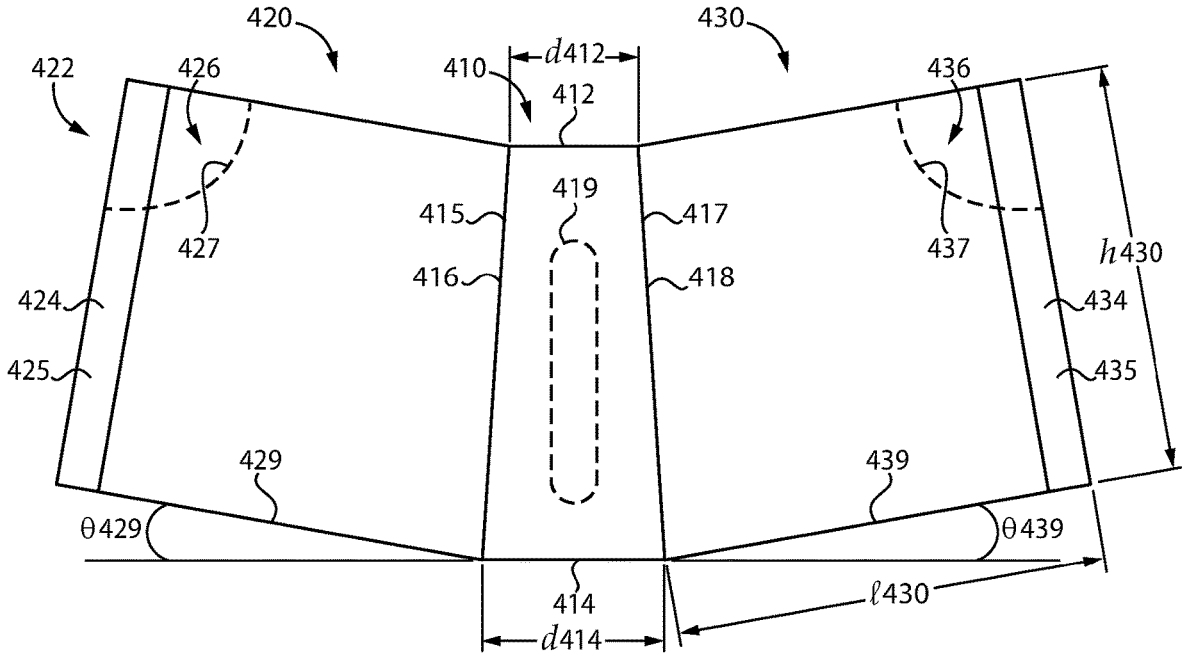
FIG. 5 is a plan view of a skirt according to certain embodiments.

With additional reference to FIG. 5, illustrated therein is a skirt 400, which is another example of the skirt 210. The skirt 400 generally includes a base panel 410, a first side panel 420 extending from a first side of the base panel 410, and a second side panel 430 extending from the opposite second side of the base panel 410. While other materials and forms are contemplated, in the illustrated embodiment, the skirt 400 is formed of a plastic sheet.

The base panel 410 includes an upper edge 412, a lower edge 414, a first side 416 extending between the upper edge 412 and the lower edge 414, and an opposite second side 418 extending between the upper edge 412 and the lower edge 414. In certain forms, the first side 416 may be defined by a crease 415 and/or the second side 418 may be defined by a crease 417. Creases 415, 417 may, for example, be provided in the form of an indented line and/or a line of perforations. In certain forms, such creases 415, 417 may be omitted. In certain forms, the base panel 410 further includes a center cutout 419 sized and shaped to accommodate a portion of the rear portion 112.

The first side panel 420 extends from the first side 416 of the base panel 410 to a first end 422 of the skirt 400. The first end 422 may have positioned thereon a first releasable securing means such as a first adhesive region 424, which may be covered by a removable protective film 425. It is also contemplated that the first securing means may be provided in another form, such as one that includes a hook-and-loop fastener strip, a hook-hook fastener strip, and/or one or more suction cups. The first side panel 420 may further include a cutout 426 sized and shaped to accommodate a portion of the bowl 114. The cutout 426 may have a curved edge 427 that generally conforms to the curved line defining the intersection of the bowl 114 and the first side surface 117. It is also contemplated that the edge 427 may be tapered or straight to define the cutout 426 as a tapered or straight cutout.

In the illustrated form, the second side panel 430 is a mirror image of the first side panel 420, and extends from the second side 418 of the base panel 410 to a second end 432 of the skirt 400. It is also contemplated that the second side panel 430 may not necessarily be a mirror image of the first side panel 420. The second end 432 may have positioned thereon a second releasable securing means such as a second adhesive region 434, which may be covered by a removable protective film 435. It is also contemplated that the second securing means may be provided in another form, such as one that includes a hook-and-loop fastener strip, a hook-hook fastener strip, and/or one or more suction cups. The second side panel 430 may further include a cutout 436 sized and shaped to accommodate a portion of the bowl 114. The cutout 436 may have a curved edge 437 that generally conforms to the curved line defining the intersection of the bowl 114 and the second side surface 118. It is also contemplated that the edge 437 may be tapered or straight to define the cutout 436 as a tapered or straight cutout.

While other geometries are contemplated, in the illustrated form, the base panel 410 is substantially trapezoidal. The upper edge 412 has a first length dimension d412, and the lower edge 414 has a second length dimension d414 greater than the first length dimension d414. Additionally, when the skirt 400 is laid flat, lower edges 429, 439 of the side panels 420, 430 define oblique angles θ429, θ439 relative to the lower edge 414 of the base panel 410. This arrangement may aid in conforming the skirt 400 to the geometries of certain forms of the toilet 100.

Certain embodiments of the present disclosure relate to methods of retrofitting an existing toilet 100 with a skirt 210 in order to provide a toilet assembly 200. While an example method will now be described with specific reference to the skirt 300 illustrated in FIG. 4, it is to be appreciated that the method may alternatively be performed with the skirt 400 illustrated in FIG. 5 or other skirts having similar features.

Figure 6:
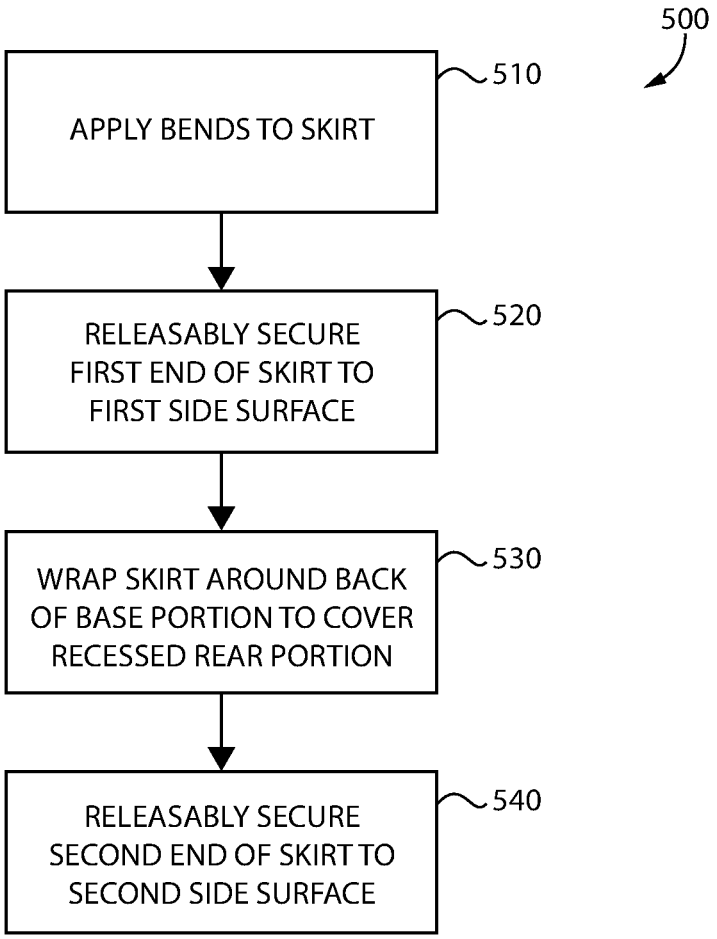
FIG. 6 is a schematic flow diagram of a process according to certain embodiments.

With additional reference to FIG. 6, illustrated therein is a process 500 according to certain embodiments. Blocks illustrated for the process 500 are understood to be examples only, and blocks may be combined or divided, and added or removed, as well as re-ordered in whole or in part, unless explicitly stated to the contrary. Additionally, while the blocks are illustrated in a relatively serial fashion, it is to be understood that two or more of the blocks may be performed concurrently or in parallel with one another.

The process 500 may include block 510, which generally involves applying bends to the skirt 300. Block 510 may, for example, involve applying the bends along the creases 315, 317 to define the first and second sides 316, 318 of the base panel 310. In other forms, block 510 may be omitted. For example, the process 500 may instead involve applying the skirt 300 to the toilet 100 in a continuously-curved form.

The process 500 includes block 520, which generally involves releasably securing the first end 322 of the skirt 300 to the first side surface 117 of the toilet base portion 110 using the first releasable securing means. Block 520 may involve positioning the first side panel 320 such that a portion of the bowl 114 is accommodated in the first cutout 326, and releasably securing the first end 322 to the first side surface 117 with the bowl 114 accommodated in the first cutout 326. In certain embodiments, such as those in which the first releasable securing means comprises one or more suction cups, block 520 may involve applying the suction cups to the first side surface 117 to releasably secure the first end 322 to the first side surface 117.

In certain embodiments, block 520 may involve adhering the first end 322 to the first side surface 117 using the first adhesive region 324. In certain embodiments, block 520 may involve removing the protective film 325 to expose the first adhesive region 324, and adhering the first end 322 of the skirt 300 to the first side surface 117 using the first adhesive region 324. In other forms, such as those in which the skirt 300 does not include the adhesive region 324, block 520 may involve adhering the first end 322 of the skirt 300 to the first side surface 117 using a separate adhesive, such as tape or glue.

In certain embodiments, the first releasable securing means may comprise a hook-and-loop fastener mechanism including a first strip (e.g. one of a hook strip or a loop strip) adhered to the first end 322 and a second strip (e.g., the other of a hook strip or a loop strip) having an adhesive side. In such forms, block 520 may involve applying the second strip to the first side surface 117 using the adhesive side such that the hooks or loops are exposed, and engaging the first strip with the second strip to releasably secure the first end 322 to the first side surface 117. Similar acts may be performed in embodiments in which the first releasable securing means comprises a hook-hook fastener mechanism.

The process 500 also includes block 530, which generally involves wrapping the skirt 300 around the back of the base portion 110 to cover the recessed rear portion 112. In certain embodiments, such as those in which the base panel 310 includes the center cutout 319, block 530 may involve positioning a portion of the rear portion 112 in the center cutout 319.

The process 500 includes block 540, which generally involves releasably securing the second end 332 of the skirt 300 to the second side surface 118 of the toilet base portion 110 using the second releasable securing means. Block 540 may involve positioning the second side panel 330 such that a portion of the bowl 114 is accommodated in the second cutout 336, and releasably securing the second end 332 to the second side surface 118 with the bowl 114 accommodated in the second cutout 336. In certain embodiments, such as those in which the second releasable securing means comprises one or more suction cups, block 540 may involve applying the suction cups to the second side surface 118 to releasably secure the second end 332 to the second side surface 118.

In certain embodiments, block 540 may involve adhering the second end 332 to the second side surface 118 using the second adhesive region 334. In certain embodiments, block 540 may involve removing the protective film 335 to expose the first adhesive region 334, and adhering the second end 332 of the skirt 300 to the second side surface 118 using the first adhesive region 334. In other forms, such as those in which the skirt 300 does not include the adhesive region 334, block 540 may involve adhering the second end 332 of the skirt 300 to the second side surface 118 using a separate adhesive, such as tape or glue.

In certain embodiments, the second releasable securing means may comprise a hook-and-loop fastener mechanism including a first strip (e.g. one of a hook strip or a loop strip) adhered to the second end 332 and a second strip (e.g., the other of a hook strip or a loop strip) having an adhesive side. In such forms, block 540 may involve applying the second strip to the second side surface 118 using the adhesive side such that the hooks or loops are exposed, and engaging the first strip with the second strip to releasably secure the second end 332 to the second side surface 118. Similar acts may be performed in embodiments in which the second releasable securing means comprises a hook-hook fastener mechanism.

With the process 500 completed, the conventional toilet 100 has been retrofitted with the skirt 210 (e.g., the skirt 300 or the skirt 400) to form the toilet assembly 200. In this state, the skirt 210 covers the recessed rear portion 112, thereby giving the appearance of a skirted toilet at significantly lower cost. The color of the skirt 210 may be selected to match the color of the toilet 100 to further enhance this appearance. The skirt 210 also aids in reducing the build-up of dust and grime in the recessed rear portion 112, and may provide a smooth surface that is more easily cleaned than the contoured and recessed rear portion 112 of the toilet 100. When the skirt 210 becomes dirty, the skirt 210 may be removed for cleaning or discarded. In certain forms, the adhesive regions are provided as releasable adhesive regions that facilitate the removal of the skirt 210. Additionally or alternatively, the adhesive regions may be provided as reusable or replaceable adhesive regions that facilitate the use of the same skirt 210 multiple times.

As noted above, the skirt 210 may be formed of a flat plastic sheet. Such a plastic sheet may have a sufficient flexibility to allow the skirt 210 to be bent or curved into its final shape, while having sufficient rigidity to maintain such a shape under light cleaning (e.g. wiping and/or dusting). In certain forms (including but not limited to those in which the skirt 210 is provided with creases), the skirt 210 may be bent into a H shape, while in other embodiments, the skirt 210 may be curved into a C shape.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method of retrofitting a toilet comprising a base portion having a recessed rear portion and a front portion including a first side surface and a second side surface opposite the first side surface, the method comprising:

providing a skirt, the skirt comprising:

a base panel having an upper edge, a lower edge, a first side extending between the upper edge and the lower edge, and a second side extending between the upper edge and the lower edge;

a first side panel extending from the first side of the base panel, the first side panel comprising a first cutout sized and shaped to accommodate a first portion of the bowl, and first releasable securing means positioned near a first end of the first side panel, wherein the first end of the first side panel is opposite the first side of the base panel; and a second side panel extending from the second side of the base panel, the second side panel comprising a second cutout sized and shaped to accommodate a second portion of the bowl, and second releasable securing means positioned near a second end of the second side panel, wherein the second end of the second side panel is opposite the second side of the base panel;

releasably securing the first end of the first side panel of the skirt to the first side surface;

wrapping the skirt around the recessed rear portion such that the recessed rear portion is covered by the skirt; and releasably securing the second end of the second side panel of the skirt to the second side surface.

2. The method of claim 1, further comprising accommodating the first portion of the bowl in the first cutout; and accommodating the second portion of the bowl in the second cutout.

3. The method of claim 1, wherein releasably securing the first end of the skirt to the first side surface comprises adhering the first end of the skirt to the first side surface; and wherein releasably securing the second end of the skirt to the second side surface comprises adhering the second end of the skirt to the second side surface.

4. The method of claim 3, further comprising:

removing a first protective film from the first end of the first side panel of the skirt to expose a first adhesive region, wherein releasably securing the first end of the skirt to the first side surface comprises adhering the first end of the skirt to the first side surface via the first adhesive region; and removing a second protective film from the second end of the second side panel of the skirt to expose a second adhesive region, wherein adhering the second end of the skirt to the second side surface comprises adhering the second end of the skirt to the second side surface via the second adhesive region.

5. A toilet assembly, comprising:

a toilet comprising a base portion, the base portion including a recessed rear portion, a bowl, and a front portion, the front portion including a first side surface and a second side surface opposite the first side surface; and a skirt, the skirt comprising:

a base panel having an upper edge, a lower edge, a first side extending between the upper edge and the lower edge, and a second side extending between the upper edge and the lower edge;

a first side panel extending from the first side of the base panel, the first side panel comprising a first cutout sized and shaped to accommodate a first portion of the bowl, and first releasable securing means positioned near a first end of the first side panel, wherein the first end of the first side panel is opposite the first side of the base panel; and a second side panel extending from the second side of the base panel, the second side panel comprising a second cutout sized and shaped to accommodate a second portion of the bowl, and second releasable securing means positioned near a second end of the second side panel, wherein the second end of the second side panel is opposite the second side of the base panel;

wherein the skirt covers the recessed rear portion, wherein the first end of the first side panel is releasably secured to the first side surface, and wherein the second end of the second side panel is releasably secured to the second side surface.

6. The toilet assembly of claim 5, wherein the upper edge has a first length, and wherein the lower edge has a second length greater than the first length.

7. The toilet assembly of claim 6, wherein the base panel is trapezoidal.

8. The toilet assembly of claim 5, wherein the base panel comprises a further cutout through which a portion of the rear portion extends.

9. The toilet assembly of claim 5, wherein the first end of the first side panel comprises a first adhesive region by which the first end is adhered to the first side surface; and wherein the second end of the second side panel comprises a second adhesive region by which the second end is adhered to the second side surface.

10. A skirt for a toilet comprising a bowl, the skirt comprising:

a base panel having an upper edge, a lower edge, a first side extending between the upper edge and the lower edge, and a second side extending between the upper edge and the lower edge;

a first side panel extending from the first side of the base panel, the first side panel comprising:

a first curved cutout sized and shaped to accommodate a first portion of the bowl; and first releasable securing means positioned near a first end of the first side panel, wherein the first end of the first side panel is opposite the first side of the base panel; and a second side panel extending from the second side of the base panel, the second side panel comprising:

a second curved cutout sized and shaped to accommodate a second portion of the bowl; and second releasable securing means positioned near a second end of the second side panel, wherein the second end of the second side panel is opposite the second side of the base panel;

wherein the skirt is operable to be laid flat.

11. The skirt of claim 10, wherein the first securing means comprises a first adhesive region, and wherein the second releasable securing means comprises a second adhesive region.

12. The skirt of claim 11, further comprising a first removable film covering the first adhesive region, and a second removable film covering the second adhesive region.

13. The skirt of claim 10, wherein the lower edge is longer than the upper edge such that the base panel is trapezoidal.

14. The skirt of claim 10, wherein each of the first side panel and the second side panel comprises a corresponding and respective lower edge that extends at an oblique angle relative to the lower edge of the base panel when the skirt is laid flat.

15. The skirt of claim 10, wherein the skirt is formed of a plastic sheet.

16. The skirt of claim 10, wherein each of the first side and the second side is defined by a corresponding and respective crease.

17. The skirt of claim 16, wherein each crease comprises at least one of an indented line, a line of perforations, or a formed radius.

* * * * *